US005111976A

United States Patent [19]

Ban

[11] Patent Number: 5,111,976

[45] Date of Patent: May 12, 1992

[54] POWDER DEVELOPER CONTAINER WITH A SEALING MEMBER HAVING SPECIFIC HARDNESS, COMPRESSIVE SET, FRICTION COEFFICIENT AND COMPRESSION

[75] Inventor: Yutaka Ban, Tokyo, Japan

[73] Assignee: Canon Kabushiki Kaisha, Tokyo, Japan

[21] Appl. No.: 638,023

[22] Filed: Jan. 7, 1991

Related U.S. Application Data

[63] Continuation of Ser. No. 257,018, Feb. 28, 1990, abandoned.

[30] Foreign Application Priority Data

Oct. 15, 1987 [JP] Japan ..... 62-260856

[51] Int. Cl.[5] ..... B65B 1/06

[52] U.S. Cl. ..... 222/485; 222/502; 222/555; 222/DIG. 1; 141/364

[58] Field of Search ..... 222/DIG. 1, 325, 502, 222/485, 548, 555, 542, 486; 141/363-366

[56] References Cited

U.S. PATENT DOCUMENTS

| | | | |
|---|---|---|---|
| 3,915,208 | 10/1975 | Anderson | 222/DIG. 1 |
| 3,991,974 | 11/1976 | Bonafus | 251/366 |
| 4,033,325 | 7/1977 | Walker | 126/434 |
| 4,052,112 | 10/1977 | Faber | 384/16 |
| 4,060,105 | 11/1977 | Feldeisen et al. | 222/DIG. 1 X |
| 4,117,773 | 10/1978 | Johnson | 202/263 X |
| 4,248,246 | 2/1981 | Ikeda | 128/765 |
| 4,476,987 | 10/1984 | Nolan | 411/307 X |
| 4,592,987 | 6/1986 | Mitsuhashi et al. | 222/DIG. 1 X |
| 4,608,282 | 8/1986 | Runtge | 208/18 X |
| 4,615,364 | 10/1986 | Kawata | 222/DIG. 1 X |
| 4,615,608 | 10/1986 | Mizutani | 222/DIG. 1 X |
| 4,870,463 | 9/1989 | Miyoshi et al. | 222/DIG. 1 |
| 4,930,684 | 6/1990 | Patterson | 222/325 |

*Primary Examiner*—Michael S. Huppert
*Assistant Examiner*—Kenneth DeRosa
*Attorney, Agent, or Firm*—Fitzpatrick, Cella, Harper & Scinto

[57] ABSTRACT

A powder developer container in which an opening through which a powder developer can be discharged is formed by a relative movement between a pair of shutter members in which a sealing member is interposed thereinbetween. The sealing member is fixed to one of the pair of shutter members and slidable relative to the other one of the pair of shutter members. The sealing member has a hardness of 20 to 70, a compressive set lower than 4%. A coefficient of friction $\mu$ between itself and the mating member on which the sealing member is slidable is not greater than 0.8. The sealing member is compressed between the pair of shutter members at a compression rate higher than 20%.

12 Claims, 4 Drawing Sheets

POWDER DEVELOPER CONTAINER WITH A SEALING MEMBER HAVING SPECIFIC HARDNESS, COMPRESSIVE SET, FRICTION COEFFICIENT AND COMPRESSION

This application is a continuation of application Ser. No. 257,018 filed Feb. 28, 1990, now abandoned.

BACKGROUND OF THE INVENTION

1. Field of the Invention

This invention relates to a developer container for replenishing an electrostatic copier or printer with a powder developer. More particularly, this invention relates to a developer container having a rotary or sliding valve provided at an outlet through which the developer is discharged.

2. Description of the Prior Art

Previously, valves for use in a developer container for replenishing an electrostatic-type copier or printer with powder developer have movable and fixed parts wherein moving (i.e., operating) the movable part of the valve device operates to open or close a discharge opening of the container. Packing is generally interposed between the movable and fixed parts in order to effect powder sealing such that when the discharge opening is closed, a compressive stress is applied to the packing. Conventionally, this packing is formed from an elastic material such as a rubber or rubber sponge, e.g., EPDM (a terpolymer elastomer made from ethylene-propylene diene monomer), chloroprene rubber, or urethane rubber, or from a foamed material made of polyethylene, polypropylene, polyurethane and the like.

Thus, the sealing properties of the valve device are produced and maintained by compressing the packing member and bringing the same into close contact with the mating member by virtue of an elasticity force thereby produced. However, since developer for processing in electrophotographic copiers or printers is a fine powder with a particle size of less than about 20 μm with a fluidity-enhancing additive such as silica, a high degree of sealing performance is required. Thus, compressive stress may be increased so as to improve the sealing performance. In practice, however, increased compression makes it very difficult to smoothly open or close the valve because of an increase in the vertical reaction. If, conversely, the compressive stress is reduced, or if the packing is formed from a harder material so as to facilitate easier operation of the valve, sealing performance decreases. In this instance, even though the container is otherwise free from developer leaks under ordinary conditions, it nevertheless cannot remain completely sealed if it is dropped and receives an impact, or if it is used under severe conditions such as a low-temperature environment. In these events, it is necessary to utilize additional conventional sealing means such as fusing. However, it is not preferable to utilize fused containers for developer containment because once such developer container is opened, it is not possible to restore a requisite state of sealing thereto.

SUMMARY OF THE INVENTION

It is an object of the present invention to provide a developer container with improved sealing properties which is capable of being smoothly opened and closed.

It is another object of the present invention to provide a developer container which is capable of maintaining a suitable degree of sealing performance during long-term storage.

To these ends, the present invention provides a powder developer container for a powder developer in which an opening through which the developer contained therein can be discharged is formed by relative movement between a pair of shutter members wherein the container has a sealing member fixed to one of the pair of shutter members, slidable relative to the other of the pair of shutter members and interposed thereinbetween, the sealing member having a hardness of 20° to 70° and a compressive set below 4%; a coefficient of friction μ between itself and the mating surface of the shutter member on which it is slidable of at most 0.8; and the sealing member being compressed between the shutter members at a compression rate higher than 20%.

In accordance with the present invention, the sealing member is formed from a material having a small compressive set, a suitable hardness and degree of smoothness (friction coefficient) which is suitably compressed, thereby enabling improved sealing performance while still allowing the container to be smoothly opened or closed. That is, the compressive set of the sealing member is set to be lower than 4%, a level which is specifically effective for preventing sealing performance deterioration. That is, if compressive set is above 4% and a powder developer container is stored for a long period of time while the sealing member is pinched and compressed between two members constituting the opening through which the power developer can be discharged, a deformation due to compression, namely, a compressive set remains after the sealing member is released from the compressed state. Since the level of compressive stress at the deformed portion is reduced, sealing performance deteriorates. Setting the hardness of the sealing member from 20° to 70° effectively improves sealing performance by allowing the sealing member to closely contact the member constituting the opening. Also, providing that the coefficient of friction between the sealing member and the mating member slidable relative thereto is not greater than 0.8 enables the two members constituting the opening to be opened or closed smoothly.

DESCRIPTION OF THE PREFERRED EMBODIMENTS

Figure 1:
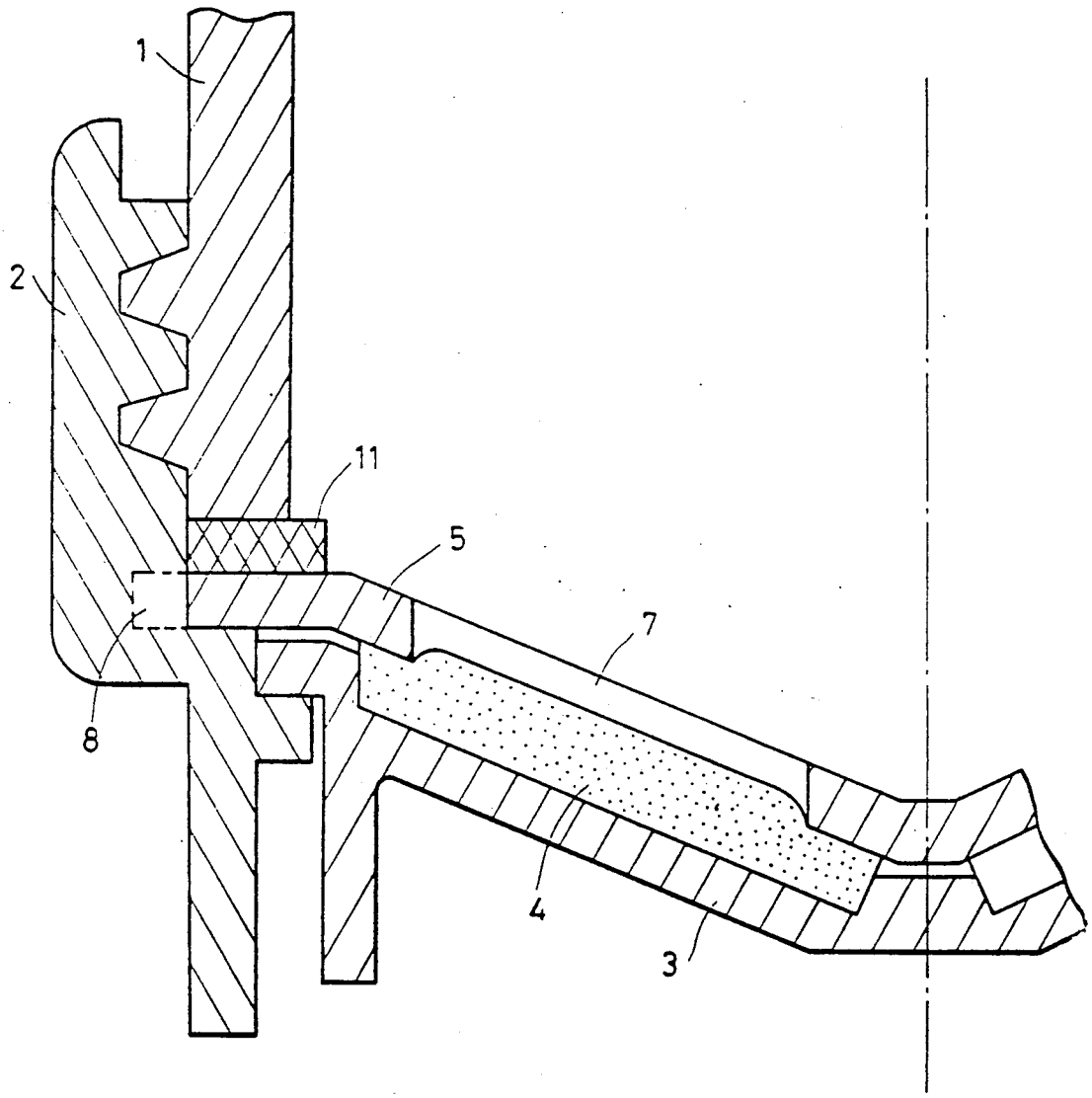
FIG. 1 is an enlarged cross-sectional view of one embodiment of the present invention.

The sealing member utilized herein may be a rubber or sponge rubber member which is elastic with improved sealing properties. To form this member, a type of rubber material is selected so as to provide that the coefficient of friction between the sealing member and the mating member slidable thereon is no larger than 0.8 since if the friction coefficient is too large, it will be difficult to open the opening portion. Moreover, if the foamed material used to provide the sealing member is formed from polyethylene, polypropylene, polyurethane of the like, it is preferable to reduce its cell size. More preferably, the cell size should be smaller than 300

μm since if the cell size is comparatively large, there is a possibility the sealing performance of a power developer having a very small particle size will be reduced. Ordinarily, a foamed material is formed with an expansion ratio ranging from 5 to 100. However, such a foamed material has a large void area and so, does not adequately resist compressive stress. In other words, such material is readily deformed with a large compressive set. It is therefore preferable to select a material with an expansion ratio lower than 3. In consideration of the use of the sealing member in a low-temperature environment, it is also preferable for this member to be formed from an elastic material which does not harden at least to a temperature of about −20° C.

Examples of materials which are specially effective for this kind of use and which satisfy the above-described conditions include polyurethane foam and silicone rubber sponge. Preferably, in the case of foamed polyurethane, the cell size is smaller than 300 μm and the apparent specific gravity is about 0.2 to 0.5 g/cm$^3$. Other suitable materials may readily be selected by the employment of routine procedures commonly known to those of ordinary skill in the art.

Sealing performance is effected when the sealing member is compressed between the two members constituting the opening portion through which powder developer is discharged. In this case, it is preferable to set the compression rate to be higher than 20% or, more preferably, 30%. That is to say, it is preferable to set the thickness of the sealing member in the compressed state to be less than 80% or, more preferably, 70% of the thickness of the sealing member in the non-compressed state.

The hardness of the sealing member is measured on the basis of a method (JIS-K-6301) for measuring the hardness of rubber pieces used as sealing members, that is, it is measured by a spring type of model-A hardness tester having a needle which has a diameter of 0.79 mm and which is spring-biased so as to protrude beyond a reference surface by 2.54 mm. The distance by which the needle retracts by a pressing force of a test piece when the reference surface is brought into contact with the test piece is thereby measured, and the hardness is calculated by the following formula:

$$\text{Hardness} = \frac{\text{Retracting distance (mm)}}{2.54\text{ mm}} \times 100$$

The compressive set of the sealing member is measured in conformity with JIS-K-6301. That is, the test piece is left at 70° C. for 22 hours while being 25%-compressed (i.e., such that its compressed thickness is 75% of its original thickness). It is thereafter released from the compressed state and is left at room temperature for 30 minutes. The thickness of the test piece is thereafter measured, and the compressive set is calculated by the following formula:

$$\text{Compressive set} = \frac{\text{Thickness of test piece} - \text{Thickness after 30 minutes standing}}{\text{Thickness of test piece} - \text{Thickness during compression}} \times 100$$

The coefficient of friction between the sealing member and the mating member slidable thereon occurred under the following conditions. A test piece of sealing member material having a diameter of 18 mm and a thickness of 3 mm is placed on a mating member slidable relative to the test piece and is pulled in the horizontal direction while being loaded with 200 g. The force required to make the test piece start moving is measured and the friction coefficient is calculated by the following formula:

$$\text{Friction coefficient} = \frac{\text{Force required to start test piece (g)}}{\text{Force of load (g)}}$$

EMBODIMENT 1

Figure 2:
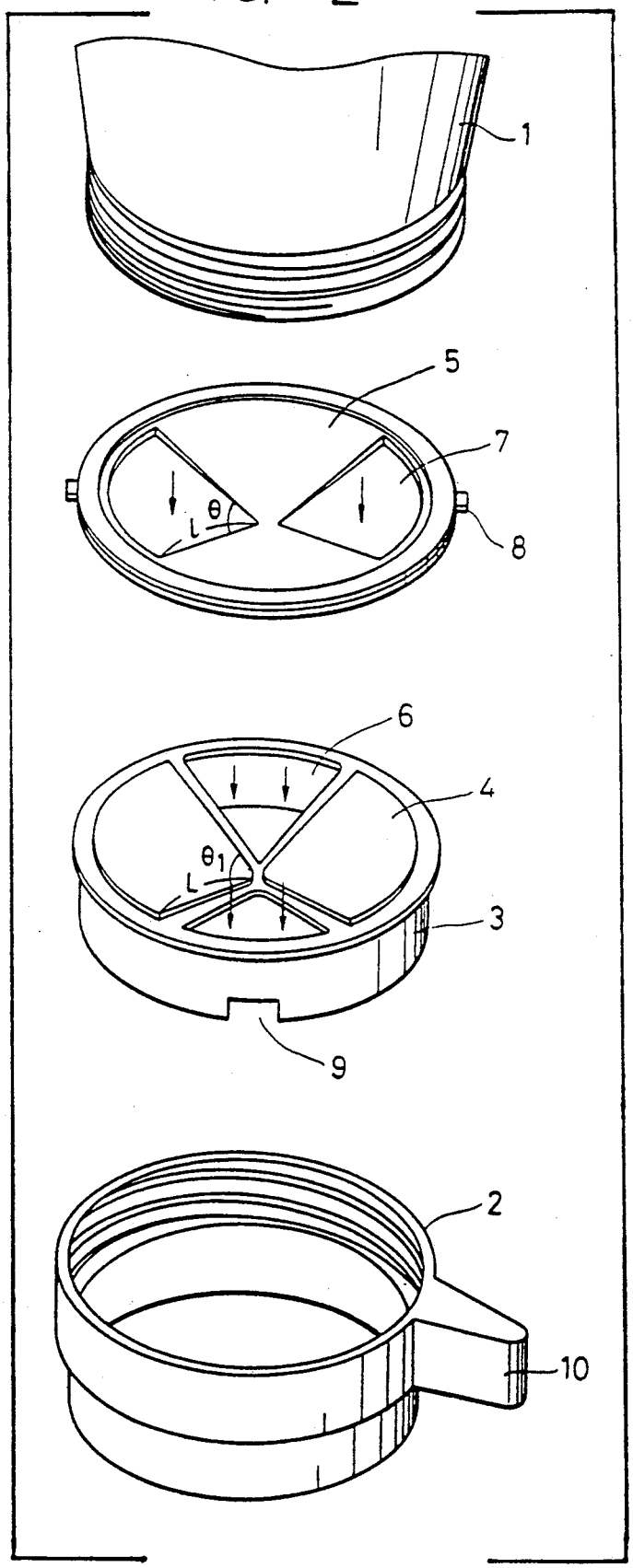
FIG. 2 is an exploded perspective view of the developer container shown in FIG. 1.

FIGS. 1 and 2 show a first embodiment of the present invention. Referring to FIG. 2, a developer container has a bottle 1 provided as a main body of the developer container. A frame 2 of a cap is screwed around a mouth of the bottle. A shutter 3 which has a conical shutter portion with sectoral openings 6 is movably disposed in the cap (hereinafter referred to as "movable shutter"). Packings 4 are fixed to the movable shutter 3 by a suitable means such as a pressure sensitive adhesive double-coated tape or an adhesive. The packings 4 are formed from a small-foaming-rate polyurethane foam having a hardness of 30 to 35, a compressive set of 3.1%, a friction coefficient of 0.38, a cell size of 80 to 120 μm, and an apparent specific gravity of 0.32. A fixed shutter 5 has a conical portion capable of fittingly contacting the conical surface of the movable shutter 3, and sectoral openings 7 each having the same configuration as that of the sectoral openings 6 of the movable shutter, and a pair of lugs 8 which fix the movable shutter 3 on the frame 2 of the cap. In the case where the openings 6 of the movable shutter 3 and the openings 7 of the fixed shutter 5 do not overlap each other, each packing 4 is pressed against and brought into close contact with the opening 7 of the fixed shutter 5 (as shown in FIG. 1), thereby sealing the container. FIG. 1 shows an enlarged cross-sectional view of the container in a sealed-assembly state. In this embodiment, the packing 4 is formed from a polyurethane foam having a specific gravity of 0.32 and has a thickness of 2.5 mm while the distance between the conical surfaces of the movable and fixed shutters is set to 2.5 mm. That is, the compressive stress is applied to achieve a compression rate of about 20%.

To supply the developer, the container is set in the main body of the copier while the bottle is inverted so that the cap faces downward (the bottle is directed as shown in FIGS. 1 and 2). The copier has a projection which is formed in the vicinity of a developer supply opening and which is capable of engaging with a cut-out portion 9 of the movable shutter 3. The movable shutter 3 is thereby fixed to the main body of the copier. As the cap 2 is rotated through 90° from this position by a handle 10 of the cap 2, the fixed shutter 5 fixed to the cap 2 by the lugs 8 is rotated together with the bottle 1 through 90°, thereby coinciding the openings 6 of the movable shutter and the openings 7 of the fixed shutter with each other. The developer than evacuates from the interior of the bottle through openings 6, 7 and is supplied to the copier. After a desired amount of developer has been discharged, the cap is turned again to restore the original positional relationship between the openings, thereby closing the container.

A drop test for a container of this embodiment was performed (in conformity with JIS Z-0202) as described below. 1500 g of a two-component non-magnetic developer (mean particle size: 12 μm) was poured into the bottle, and the whole body of the container was set in a packaging box. Packagings prepared in this manner were dropped from a level of 90 cm in three environments, namely, at ordinary temperature, −20° C. and +45° C. As a result, no abnormality in any of the tests was observed, including no leakage of developer.

A comparison example was prepared by forming a polyethylene foam having a hardness of 20 to 25, a compressive set of 9%, a friction coefficient of 0.40, a cell size of 500 to 600 μm, and an apparent specific gravity of 0.035. A drop test for this example was performed in the above-described manner. As a result, developer leaks occurred in five out of ten containers at ordinary temperature, and leaks occurred in all the test samples at −20 ° C. Another test was performed after the compression rate had been increased from 20% to 33% by changing the thickness of the packing from 2.5 mm to 3 mm. However, leaks were still observed in all test samples after drop testing at −20° C. It was also found that the force required to open or close the shutter became excessively large for practical use if the compression rate was further increased.

The present invention will be described in more detail with respect to the operation of opening and closing the shutter. Ordinarily, the shutter of the developer container is opened or closed manually, and it is preferable to perform this operation by one hand. It is considered that the maximum force applied by one hand is not greater than 6 kgf, although it naturally varies depending upon the user.

The force required to open or close the shutter (force to press the extreme end of the handle 10) of this embodiment was measured and found to be 4.5 to 5.5 kgf, and the shutter was smoothly opened or closed. This force was measured with respect to the comparison example also. In this case, it was 0 to 4.0 kgf when the thickness of the packing was 2.5 mm, and was 3.0 to 5.0 kgf when the thickness was 3.0 mm. It exceeded 6.0 kgf in some cases when the thickness was 3.5 mm.

The operation of the shutter was tested while the material for forming the packing 4 was selected from a rubber sponge, an olefin elastomer, and a urethane elastomer listed in the following table. As a result, when the sealing and mating shutter members were brought into close contact to maintain a suitable degree of sealing performance, the force required to open or close the shutter was excessively large irrespective of the type of material utilized. A polyurethane foam and a polypropylene foam having 5–15 of hardness, 10–30% of compressive set and 0.5–1.5 of friction coefficient were also selected to form the packing 4 of the shutter, resulting in the occurrence of leaks caused by dropping impacts even though the compression rate was increased to a substantially higher level.

| Material | Hardness | Compressive set (%) | Friction coefficient |
|---|---|---|---|
| Rubber sponge | 15~50 | 5~30 | 0.7~25 |
| Olefin elastomer | 50~90 | 32~53 | 0.5~2.0 |
| Urethane elastomer | 80~95 | 30~40 | 1.0~2.5 |

EMBODIMENT 2

Figure 3:
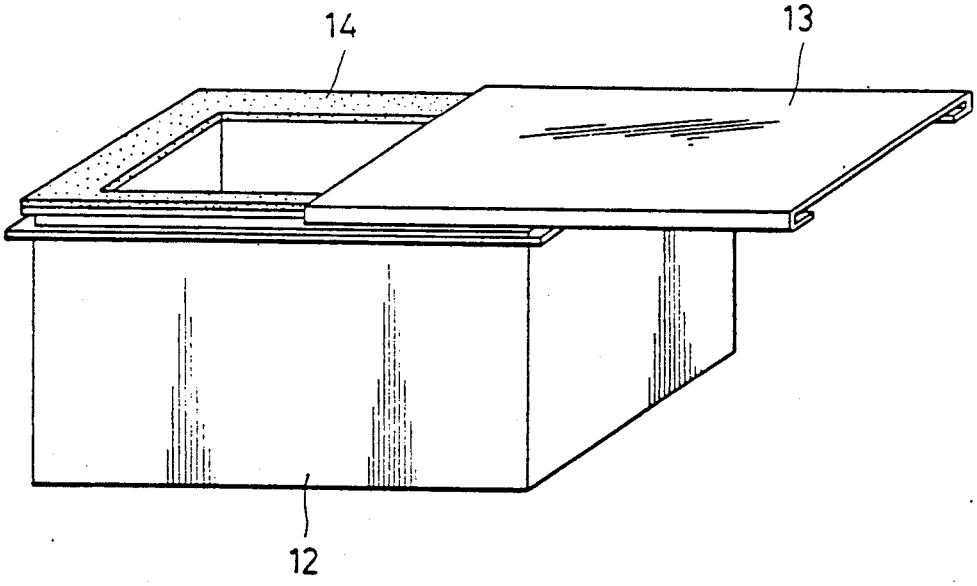
FIG. 3 is a perspective view of a second embodiment of the present invention.

FIG. 3 shows a developer container which represents another embodiment of the present invention constituted by a main body 12, a slidable lid 13 and a packing 14 which is fixed to the container body 12 which exemplifies features of the present invention. When the developer is transported or stored, the lid 13 is closed and so, compresses packing 14 to some degree, thereby sealing the developer in the container. At the time developer is replenished, the container is inverted and is set on a developer hopper or a developer supply opening of the main body of the copier. The lid 13 is thereafter slid to allow the developer to evacuate and lid 13 is slid and returned so that the container is reclosed after a desired quantity of developer has been supplied. It is therefore possible to remove the container as unnecessary waste from the body of the copier without the possibility of any small quantity of developer left within the container contaminating the copier environment or the user's hand. It was proved that, in the case where the packing 14 in accordance with the present invention was used, no abnormality took place, including leaks of the developer, even after the container had undergone the same drop test as that described above with respect to the first embodiment. At the same time, the slidable lid was capable of being opened or closed very smoothly.

This embodiment can otherwise be modified while ensuring similar effects. For example, the container body 12 may be provided with projections which are capable of engaging with the main body of the coplier so as to fix the container to the copier, and the slidable lid is designed to allow the container to be mounted on the main body of the copier only when the slidable lid is in the closed position. The slidable lid 13 may be fixed to the copier body by the side of the supply opening while the container body 12 is allowed to slide relative to the copier body to open or close the container. The packing 14 may be fixed to the lid 13 instead of being fixed to the container 12.

EMBODIMENT 3

Figure 4:
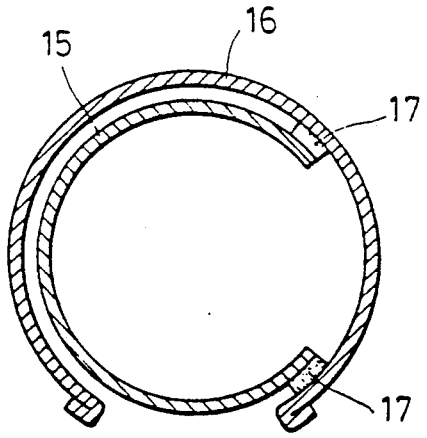
FIG. 4 is a cross-sectional view of a third embodiment of the present invention.

FIG. 4 shows in section a cylindrical container which represents still another embodiment of the present invention and which is constituted by inner and outer tubes 15 and 16 which are fitted so as to be relatively rotatable. Openings are formed in the inner and outer tubes 15 and 16 so that they can communicate with each other. A small-forming-rate polyurethane foam in accordance with the present invention provides packings 17 for sealing the inner tube when the openings of the inner and outer tubes are in the incommunicable positions. The packings 17 are interposed between inner and outer tubes 15 and 16. This embodiment is as effective as the above-described embodiments, and operated to prevent the developer from leaking from the container even when the container dropped and received impacts during transportation or storage of the developer while the openings were in the incommunicable positions. At the same time, it enabled the inner tube to be smoothly rotated at the time of replenishment of the developer.

In accordance with the present invention, as described above, a small-forming-rate polyurethane foam is used as a material to form the sealing member facing the sliding member of the shutter that closes the developer container, thereby ensuring suitable sealing performance with respect to even a type of developer formed of fine powder having a high degree of fluidity even if the container receives a jarring impact when dropped. At the same time, the sealing member of the present invention ensures that the shutter can be opened or closed smoothly by a small force. The present invention is especially effective when filled with a two-component non-magnetic toner having a small specific gravity and a high-degree of fluidity. More specifically, the container can effectively hold a toner containing a fluidizing agent such as, for example, silica.

What is claimed is:

1. A powder developer container, comprising:

a container for containing the powder developer;

a first shutter member having a first opening and including means for preventing rotation of said first shutter member when said container is rotated;

a second shutter member including means for rotating said second shutter member with respect to said first shutter member, said second shutter member being disposed between said container and said first shutter member and defining a second opening through which the developer can be discharged;

a sealing member interposed between said first and second shutter members, said sealing member being fixed to said first shutter member and being slidable relative to said second shutter member, said sealing member having a hardness of 20° to 70°, a compressive set lower than 4%, a coefficient of friction $\mu$ between itself and said second shutter member with which said sealing member is slidable no greater than 0.8, said sealing member being compressed between said first and second shutter members at a compression rate higher than 20% when said pair of shutter members is in a closed state; and an open-ended cap fitted over said first and second shutter members and secured to said container, wherein rotating said cap rotates said container and said second shutter member to align the first and second openings.

2. A container for powder developer according to claim 1, wherein said sealing member is a polyurethane foam or a silicone rubber sponge.

3. A container for powder developer according to claim 2, wherein said polyurethane foam is a small-foaming-rate plolyurethane foam having a cell size of 60 to 300 $\mu$m and a specific gravity of 0.2 to 0.5.

4. A container for powder developer according to claim 1, wherein said container contains a powder developer including a fluidizing agent.

5. A container for powder developer according to claim 4, wherein said fluidizing agent is silica.

6. A container for powder developer according to claim 1, wherein said second shutter member is fixed to said powder developer container.

7. A container for powder developer according to claim 1, wherein the compression rate at which said sealing member is compressed between said first and second shutter members when said shutter members are in a closed state is no larger than 30%.

8. A powder developer container, comprising:

a first shutter member;

a second shutter member including a mating member having open end portions, being relatively displaceable with respect to said first shutter member so as to be placed in an open state and selectively provide an opening through which the developer can be discharged;

a sealing member interposed between said first and second shutter members, said sealing member being fixed to said first shutter member and being slidable relative to said second shutter member, said sealing member having a hardness of 20° to 70°, a compressive set lower than 4%, a coefficient of friction $\mu$ between itself and said mating member of said second shutter member with which said sealing member is slidable no greater than 0.8, said sealing member being compressed between said first and second shutter members at a compression rate higher than 20% when said pair of shutter members is in a closed state, wherein said sealing member is a small-foaming-rate ployurethane foam having a cell size of 60 to 300 $\mu$m and a specific gravity of 0.2 to 0.5.

9. A container for powder developer according to claim 8, wherein said container contains a powder developer including a fluidizing agent.

10. A container for powder developer according to claim 9, wherein said fluidizing agent is silica.

11. A container for powder developer according to claim 8, wherein said first shutter member is fixed to said powder developer container.

12. A container for powder developer according to claim 8, wherein the compression rate at which said sealing member is compressed between said first and second shutter members when said shutter members are in a closed state is no larger than 30%.

* * * * *

UNITED STATES PATENT AND TRADEMARK OFFICE

CERTIFICATE OF CORRECTION

PATENT NO. : 5,111,976

DATED : May 12, 1992

INVENTOR(S) : Yutaka Ban

It is certified that error appears in the above-identified patent and that said Letters Patent is hereby corrected as shown below:

On title page, item

[56] REFERENCES CITED:

U.S. PATENT DOCUMENTS, "Runtge" should read --Runge--.

COLUMN 1:

Line 31, "diene" should read --idene--.

COLUMN 6:

Line 47, "small-forming-rate" should read --small-foaming-rate--.

Line 61, "small-forming-rate" should read --small-foaming-rate--.

COLUMN 7:

Line 45, "plolyurethane" should read --polyurethane--.

UNITED STATES PATENT AND TRADEMARK OFFICE

CERTIFICATE OF CORRECTION

PATENT NO. : 5,111,976

DATED : May 12, 1992

INVENTOR(S) : Yutaka Ban

It is certified that error appears in the above-indentified patent and that said Letters Patent is hereby corrected as shown below:

COLUMN 8:

Line 32, "ployurethane" should read --polyurethane--.

Signed and Sealed this

Third Day of August, 1993

*Attest:*

Michael K. Kirk

MICHAEL K. KIRK

*Attesting Officer*

*Acting Commissioner of Patents and Trademarks*